US009581382B2

(12) United States Patent
Yang et al.

(10) Patent No.: US 9,581,382 B2
(45) Date of Patent: Feb. 28, 2017

(54) LEVER FOR DISPENSER AND REFRIGERATOR HAVING THE SAME

(75) Inventors: Yun Ho Yang, Yongin-si (KR); Sang Woon Jeon, Namyangju-si (KR); Jae Moon Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1711 days.

(21) Appl. No.: 12/656,511

(22) Filed: Feb. 1, 2010

(65) Prior Publication Data

US 2010/0319388 A1 Dec. 23, 2010

(30) Foreign Application Priority Data

Jun. 22, 2009 (KR) ..... 10-2009-0055376

(51) Int. Cl.
*F25D 23/12* (2006.01)
*F25C 5/00* (2006.01)

(52) U.S. Cl.
CPC ..... *F25D 23/126* (2013.01); *F25C 5/005* (2013.01)

(58) Field of Classification Search
CPC ..... F25D 23/126; F25C 5/005; B67D 2210/00036; B67D 2210/00141
USPC ..... 62/389, 390
See application file for complete search history.

(56) References Cited

U.S. PATENT DOCUMENTS 4,800,935 A * 1/1989 Buchser et al. ..... 141/362
4,993,604 A * 2/1991 Gaunt et al. ..... 222/481.5
6,708,741 B1 * 3/2004 Berry ..... B67D 3/0009 141/351
8,413,460 B2 4/2013 Yang et al.
2004/0183414 A1 9/2004 Kwon
2004/0188466 A1 9/2004 Choi
2006/0131324 A1 6/2006 Noh et al.
2006/0175356 A1 8/2006 Takahashi et al.
2006/0179869 A1 8/2006 Lee et al.
2006/0196214 A1 9/2006 Lee et al.
2006/0201192 A1 9/2006 Bowen et al.
2006/0201193 A1 9/2006 Bowen et al.
2007/0102447 A1 5/2007 Fulton et al.
2007/0251261 A1 11/2007 Son et al.
2008/0053139 A1 3/2008 Park et al.
2008/0072612 A1 3/2008 Park et al.
2008/0156005 A1 7/2008 Culley et al.
(Continued)

FOREIGN PATENT DOCUMENTS

GB 1430263 A * 3/1976 ..... B29B 7/7631
KR 10-2004-0083561 10/2004
(Continued)

OTHER PUBLICATIONS

U.S. Office Action dated Jul. 25, 2012 from U.S. Appl. No. 12/820,584.
(Continued)

*Primary Examiner* — Judy Swann
*Assistant Examiner* — Zachary R Anderegg
(74) *Attorney, Agent, or Firm* — Staas & Halsey LLP

(57) ABSTRACT

A refrigerator having an operation lever for a dispenser includes first and second levers interconnected to perform respectively different functions. At least one of the first and second levers is moved relative to the other one. Accordingly, the operability and the aesthetic appearance of the refrigerator may be improved.

16 Claims, 13 Drawing Sheets

(56) References Cited

U.S. PATENT DOCUMENTS

| | | | |
|---|---|---|---|
| 2008/0156011 | A1 | 7/2008 | Culley et al. |
| 2008/0174220 | A1 | 7/2008 | Kim et al. |
| 2008/0178626 | A1 | 7/2008 | Jang et al. |

FOREIGN PATENT DOCUMENTS

| | | |
|---|---|---|
| KR | 10-0794601 | 1/2008 |
| KR | 10-2008-0072998 | 8/2008 |

OTHER PUBLICATIONS

U.S. Notice of Allowance dated Dec. 12, 2012 from U.S. Appl. No. 12/820,584.

* cited by examiner

LEVER FOR DISPENSER AND REFRIGERATOR HAVING THE SAME

CROSS-REFERENCE TO RELATED APPLICATIONS

This application claims the benefit of Korean Patent Application No. 2009-0055376, filed on Jun. 22, 2009 in the Korean Intellectual Property Office, the disclosure of which is incorporated herein by reference.

BACKGROUND

1. Field

One or more embodiments relate to an operation lever for a dispenser to optionally take out water or ice, and a refrigerator having the same.

2. Description of the Related Art

Generally, a refrigerator refers to a device to preserve food at a low temperature by supplying a cold air to a food storage chamber divided into a freezing chamber maintaining temperature under the freezing point and a refrigerating chamber maintaining temperature a little above the freezing point.

Recently, refrigerators have been developed to have a dispenser at a front side of a door so that ice or water is optionally taken out, for convenience.

The dispenser has a taking-out opening through which ice or water is discharged to a taking-out space, and a lever dedicatedly installed to operate the taking-out opening. That is, water and ice are taken out according to the operation of the lever disposed at a lower part of the respective taking-out opening.

In the dispenser, a single lever or a lever function conversion button may be provided for more efficient use of the taking-out space. More specifically, an object to be taken out is selected through the button and accordingly ice or water is optionally taken out to one taking-out space by the operation of the lever.

SUMMARY

Therefore, it is an aspect of one or more embodiments to provide a refrigerator with an operation lever for a dispenser, having improved operability, convenience of use, and an aesthetic appearance.

Additional aspects and/or advantages will be set forth in part in the description which follows and, in part, will be apparent from the description, or may be learned by practice of the embodiments.

In accordance with one aspect of one or more embodiments, an operation lever for a dispenser includes a first lever and a second lever interconnected to press a first switch and a second switch, respectively, and an interconnection of the first lever and the second lever provides operation of the first lever without moving the second lever upon only the first lever being pushed to press the first switch and provides the second lever being moved along with the first lever upon the second lever being operated to press the second switch.

The operation lever may further include a rotational shaft to which the first and the second levers are rotatably connected, and the second lever is formed relatively smaller than the first lever and disposed in front of the first lever.

The operation lever may further include a first elastic member elastically supporting the first lever to return the first lever to an initial position after being rotated, and a second elastic member elastically supporting the second lever in an opposite direction to the rotational direction of the first lever to restrict rotation of the second lever while the first lever is rotating.

The first lever may include a cut part opened to one side, and a locking protrusion formed along an inner edge of the cut part to be supported by a supporting part recessed along an edge of the second lever.

The second lever may be rotated about a rotational shaft, and the first lever may be connected to be rotated along with and slid with respect to the second lever.

The second lever may include a cut part opened to an upper part thereof and guide rails formed on both inner sidewalls of the cut part, and the first lever comprises slide grooves engaged with the guide rails.

The operation lever may further include a first elastic member to return the second lever in a rotated state to an initial state, and a second elastic member to return the first lever in a moved state to an initial position.

According to another embodiment of one or more embodiments, an operation lever for a dispenser includes a rotational shaft, a first lever rotatably connected to the rotational shaft, a second lever formed relatively smaller than the first lever, disposed in front of the first lever and rotatably connected to the rotational shaft to be rotated along with the first lever, a first elastic member elastically supporting the first lever so that the first lever is returned to an initial position after being rotated, and a second elastic member elastically supporting the second lever so as to restrict rotation of the second lever while the first lever is rotating.

In accordance with another aspect of one or more embodiments, a refrigerator may include a main body equipped with a storage chamber, a door opening and closing the storage chamber, a dispenser formed at one side of the door to enable taking-out of beverage and ice from outside, first and second switches formed at one side of the dispenser for taking-out of the beverage and ice, and an operation lever pressing the first and second switches, wherein the operation lever includes a first lever and a second lever interconnected to press the first switch and the second switch, respectively, and an interconnection of the first lever and the second lever provides operation of the first lever without moving the second lever upon only the first lever being operated to press the first switch, and provides the second lever being moved along with the first lever upon the second lever being operated to press the second switch.

The refrigerator may further include a rotational shaft to which the first and second levers are rotatably connected, a first elastic member returning the first lever in a rotated state to an initial state, and a second elastic member restricting rotation of the second lever during rotation of the first lever, and returning the second lever in a rotated state to an initial state, and the first lever may be disposed at a rear part of the second lever to be rotated along with the second lever when the second lever rotates.

The first lever may include a cut part opened to one side, and a locking protrusion formed along an inner edge of the cut part, and the second lever formed relatively smaller than the first lever comprises a supporting part engaged with and therefore supported by the locking protrusion.

The refrigerator may further include a rotational shaft to which the second lever is rotatably connected, a first elastic member returning the second lever in a rotated state to an initial state, and a second elastic member returning the first lever in a moved state to an initial position, and the first lever may be slidably connected to the second lever.

The second lever may include a cut part opened to an upper part thereof and a guide rail formed on an inner edge of the cut part, and the first lever may include a slide groove engaged with the guide rail.

In accordance with a further aspect of one or more embodiments, a refrigerator may include a main body equipped with a storage chamber, a door opening and closing the storage chamber, a taking-out space disposed at one side of the door, an ice discharging pipe and an intake port disposed at an upper part of the taking-out space to discharge ice and beverage, respectively, a first lever rotatably mounted in the taking-out space to press a first switch formed at one side of the taking-out space and thereby to discharge beverage to the intake port, and a second lever mounted at a lower part of the ice discharging pipe and moved in an up and down direction to press a second switch formed at one side of the ice discharging pipe and thereby to supply ice to the ice discharging pipe.

The ice discharging pipe may have a connection groove for one end of the second lever to reciprocate therein, and the connection groove may have an elastic member to return the second lever in a moved state to an initial position.

The second lever may include a push part formed at one end thereof to push the second lever, and a connection part formed at the other end thereof to be movably inserted in the connection groove and supported by a lower edge of the connection groove.

In accordance with a further aspect of one or more embodiments, an operation lever for a dispenser may include a first lever, and a second lever, wherein the first lever selectively operates to perform a first function without movement of the second lever, or to perform a second function with simultaneous movement of the first and second levers.

The first lever may press a first switch, and the second lever may press a second switch.

The first function may be to dispense beverage, and the second function may be to dispense ice.

The receiving container may be used to operate the first lever and the second lever.

The first lever and the second lever may be pushed to be operated.

The operation lever may further include an interconnection providing operation of the first lever without moving the second lever upon only the first lever being operated, and may provide the second lever being moved along with the first lever upon the second lever being operated.

The interconnection may engage the first lever when the second lever is operated.

The first and second levers may return to an initial position after being operated.

The first lever may be rotated about a same rotational shaft as the second lever.

BRIEF DESCRIPTION OF THE DRAWINGS

These and/or other aspects of the one or more embodiments will become apparent and more readily appreciated from the following description of the embodiments, taken in conjunction with the accompanying drawings of which.

DETAILED DESCRIPTION

Figure 1:
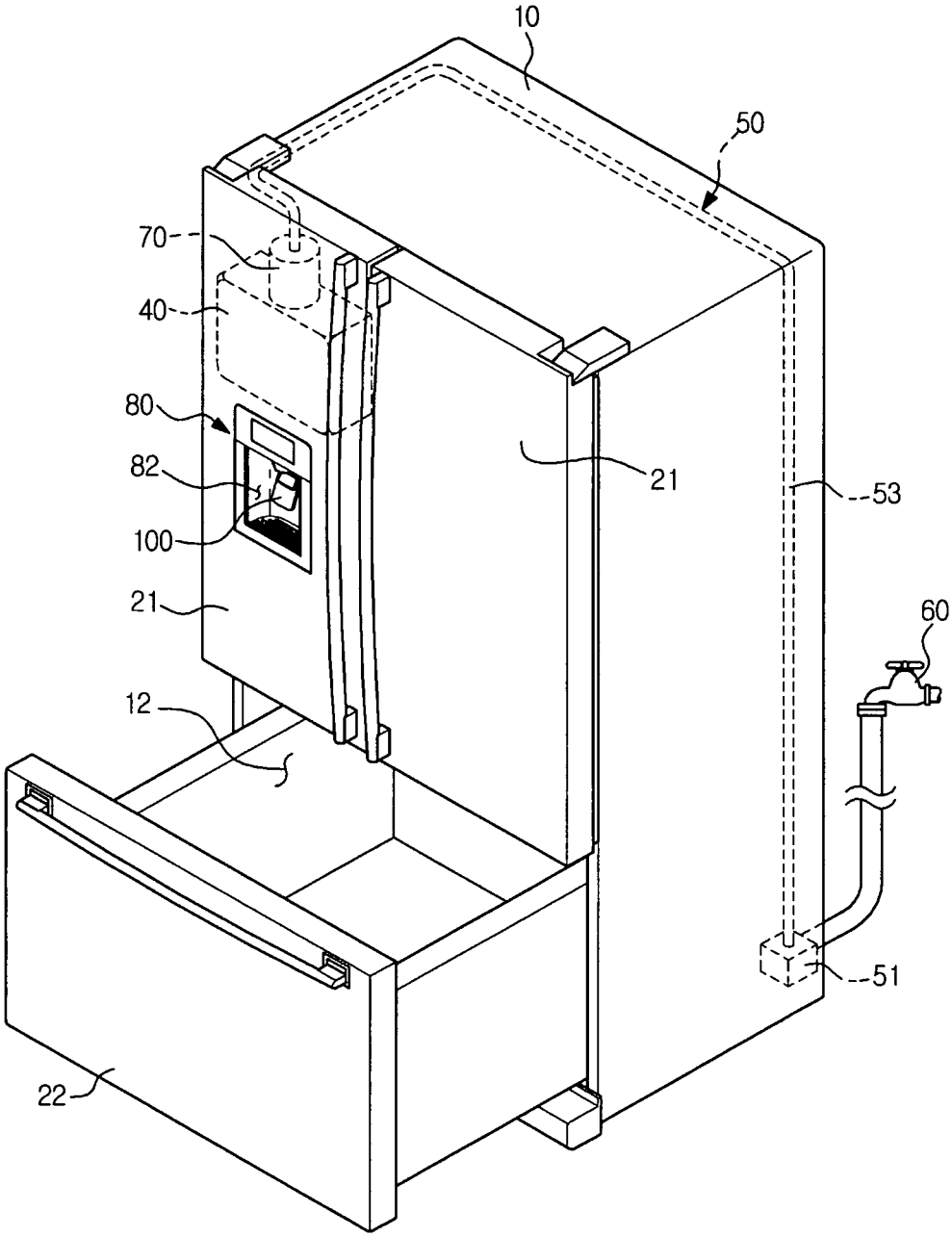
FIG. 1 is a perspective view schematically showing the external appearance of a refrigerator according to an embodiment.

Reference will now be made in detail to one or more embodiments, examples of which are illustrated in the accompanying drawings, wherein like reference numerals refer to like elements throughout.

Hereinafter, a bottom mounted freezer (BMF)-type refrigerator having a freezing chamber at a lower part thereof will be explained. However, since this is only by way of example, one or more embodiments may be applicable to any other types of refrigerators having a dispenser that selectively supplies ice and water.

Figure 2:
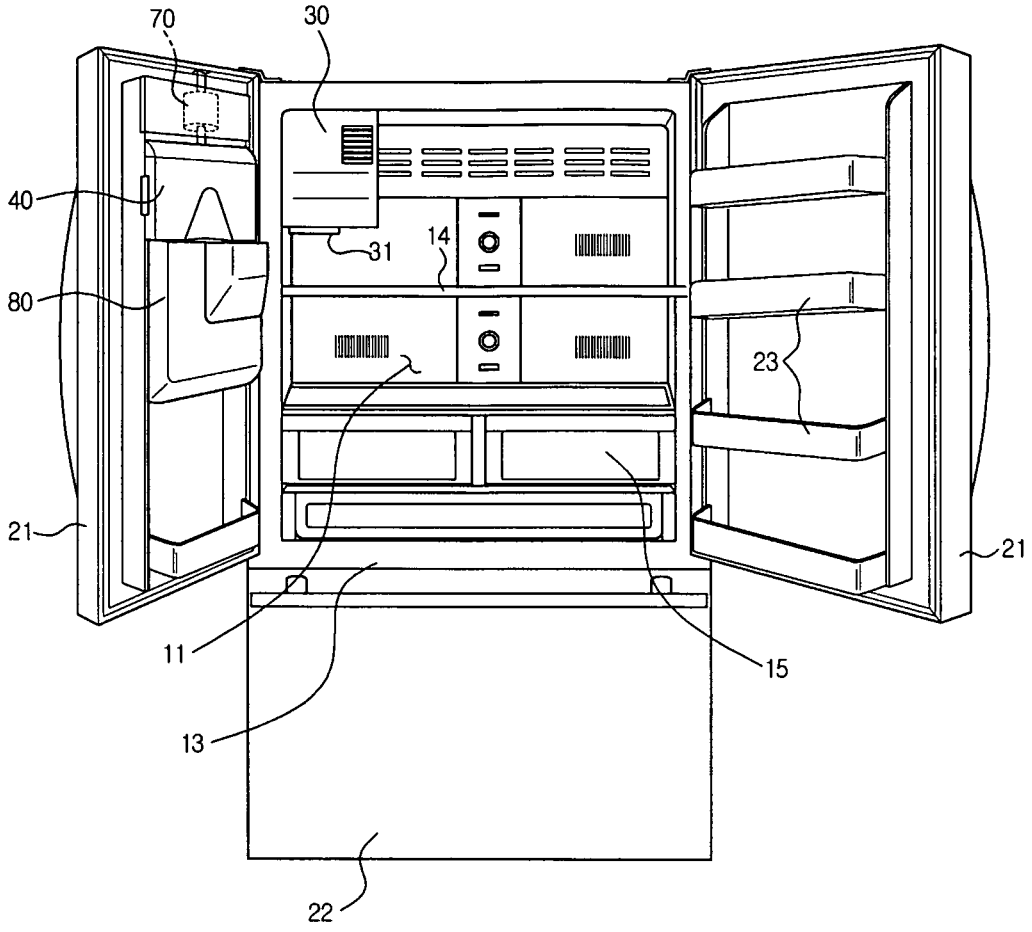
FIG. 2 is a perspective view showing the inside of the refrigerator according to an embodiment.

FIG. 1 is a perspective view schematically showing the external appearance of a refrigerator according to an embodiment and FIG. 2 is a perspective view showing the inside of the refrigerator.

Referring to FIG. 1 and FIG. 2, the refrigerator comprises a main body 10 constituted by storage chambers 11 and 12, and doors 21 and 22 opening and closing a front side of the main body 10.

The storage chambers 11 and 12 may include a refrigerating chamber 11 disposed at an upper part and a freezing chamber 12 disposed at a lower part, being defined by a horizontal partition 13 that divides an inside of the main body 10 up and down.

The refrigerating chamber 11 includes a plurality of shelves 14 disposed at an upper part thereof to put food, and a plurality of containers 15 to store food such as vegetables. In addition, an ice maker 30 to produce ice is installed at one side of the upper part of the refrigerating chamber 11.

Although not shown, the ice maker 30 may be provided with an ice making tray to produce ice therein, an ice storage to store the ice produced by the ice making tray, and an ice feeder to discharge the ice stored in the ice storage to an ice outlet 31.

The doors 21 and 22 include the refrigerating chamber doors 21 opening and closing the refrigerating chamber 11, and a freezing chamber door 22 opening and closing the freezing chamber 12.

A plurality of door guards 23 are formed on the inside of the refrigerating chamber door 21 to store beverage bottles and relatively small items.

Additionally, a dispenser 80 is mounted to the refrigerating chamber door 21 to enable a user to take out water or ice, optionally, from the outside.

The dispenser 80 is connected to a water tank 40 and the ice maker 30 mounted in the refrigerator. The water tank 40 and the ice maker 30 may be connected to the water supplying device 50 that supplies water from an external water supply source 60. The dispenser 80 includes an operation lever 100 in a taking-out space 82.

The water supplying device 50 may include a water supply valve 51 controlling supply of the water from the water supply source 60, and a water supply pipe 53 supplying water to the water tank 40 and the ice maker 30. A filter 70 purifies the water flowing into the water tank 40.

Figure 3:
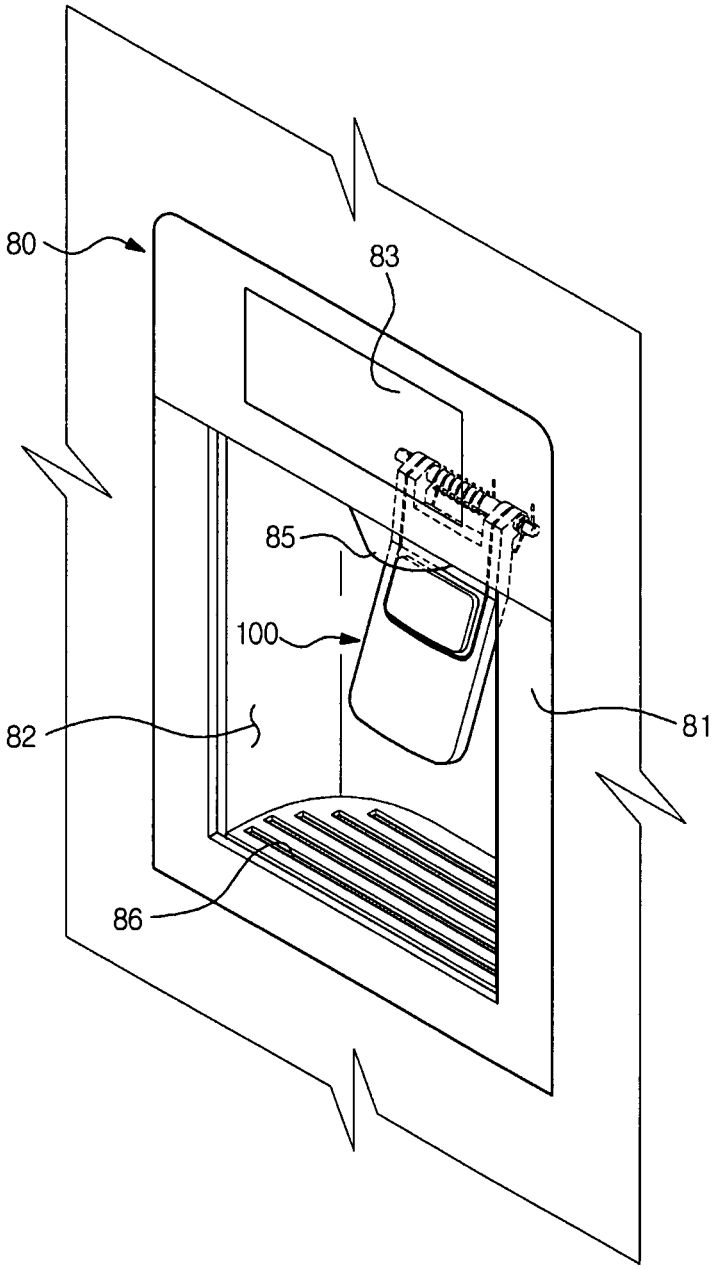
FIG. 3 is a perspective view schematically showing a dispenser of the refrigerator.

FIG. 3 is a perspective view schematically showing the dispenser of the refrigerator, according to an embodiment.

As shown in FIG. 3, the dispenser 80 includes a case 81 forming a taking-out space 82 recessed backward by a predetermined depth from the front side of the refrigerating chamber door 21 (FIG. 1). Also, a control panel 83 is formed at an upper part of the case 81, including a display unit displaying the operation states of the refrigerator and the dispenser 80, and a button unit having function buttons to select type and quantity of ice or water to be taken out.

An intake port 84 (shown in FIG. 6) supplying water from the water tank 40 (FIG. 1) and an ice discharging pipe 85 discharging ice from the ice maker 30 (FIG. 2) are provided at an upper part of the taking-out space 82. A drip reservoir 86 is provided at a lower part of the taking-out space 82 to temporarily hold water dripping during taking-out of the water.

In addition, an operation lever 100 is protruded in the taking-out space 82, which operates the dispenser 80 by being pushed.

The operation lever 100 may be constituted by separate levers respectively for taking-out of ice and water, or a single lever capable of performing different functions without the necessity of dedicatedly selecting functions through a switch.

The user may operate the operation lever 100 in a pushing manner so as to take out water or ice. Upon pushing of the operation lever 100, a taking-out signal may be accordingly transmitted to a control unit (not shown) of the refrigerator. According to this, the water supply valve 51 (FIG. 1) may be opened or an ice discharging device of the ice maker 30 (FIG. 2) may be operated, thereby discharging the object to be taken out, such as the water or ice, through the intake port 84 (shown in FIG. 6) or the ice discharging pipe 85.

Figure 4:
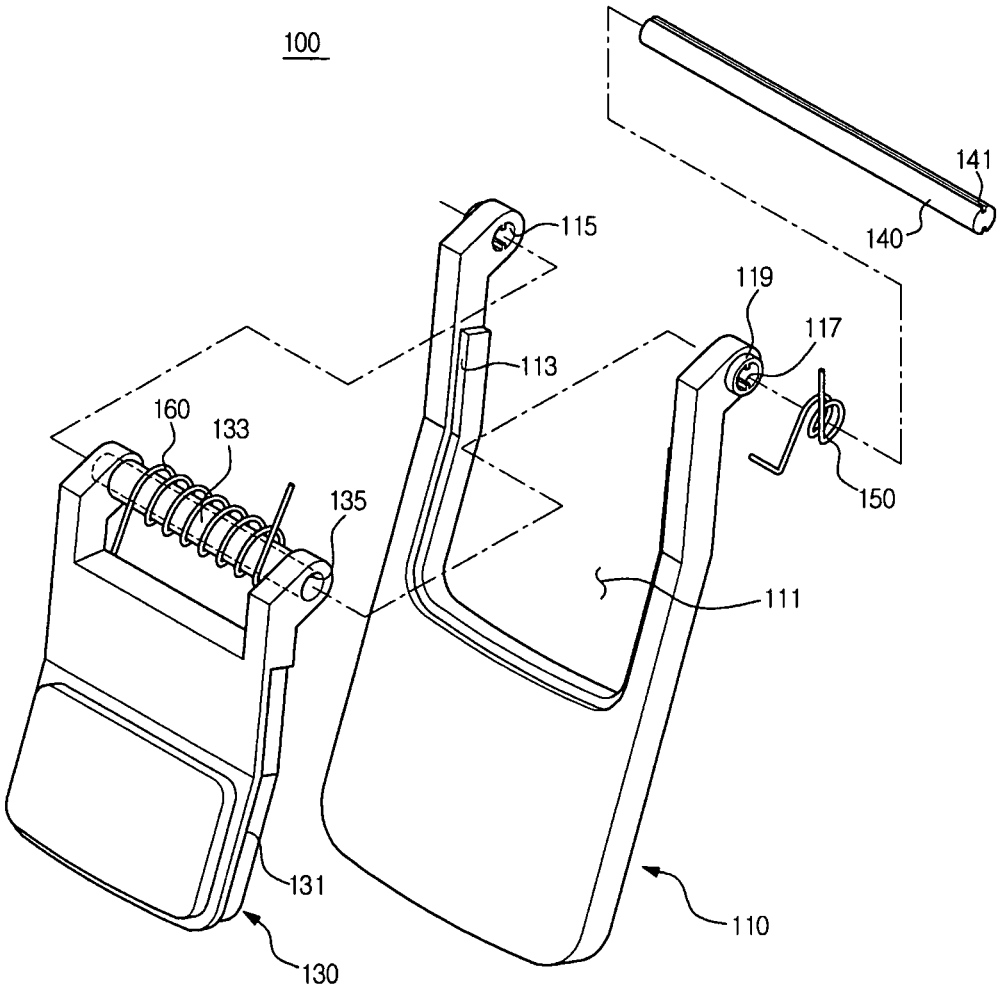
FIG. 4 is an exploded perspective view showing an operation lever for the dispenser of the refrigerator.
Figure 5:
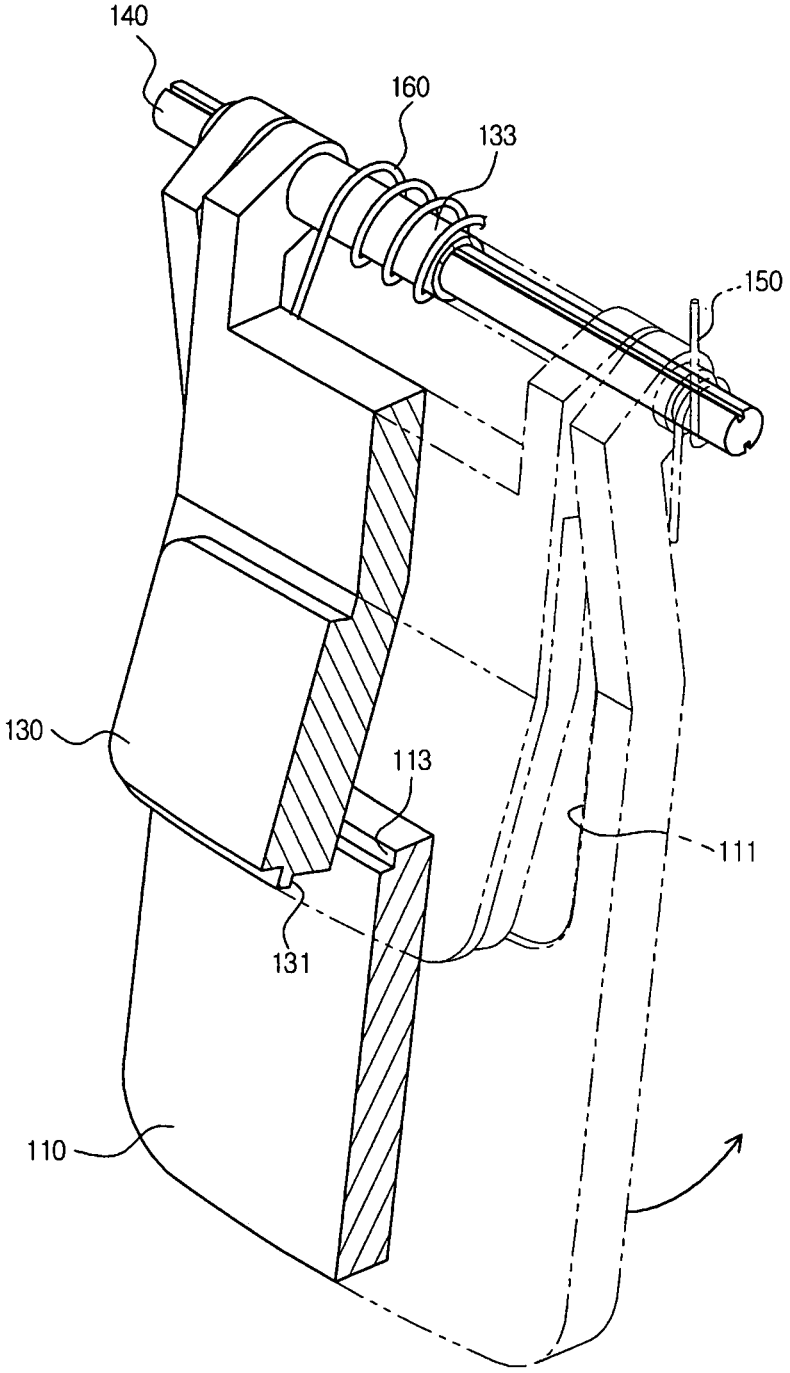
FIG. 5 is a view showing the connection structure of the operation lever for the dispenser.

FIG. 4 is an exploded perspective view schematically showing an operation lever for the dispenser of the refrigerator and FIG. 5 is a view showing the connection structure of the operation lever for the dispenser.

Referring to FIG. 4, the operation lever 100 may include a first lever 110 and a second lever 130 interconnected to perform respectively different functions.

According to the present embodiment, the first lever 110 supplies water from the water tank 40 (FIG. 1) to the dispenser 80 (FIG. 1). The second lever 130 supplies ice from the ice maker 30 (FIG. 2) to the dispenser 80 (FIG. 1). However, not being limited to this embodiment, the first and second levers 110 and 130 may selectively supply hot water and cold water, respectively, or supply different types of ice such as ice cubes and crushed ice.

For this, at least one of the first and second levers 110 and 130 may be moved relative to the other one.

More particularly, according to one embodiment of the operation lever 100 as shown in FIGS. 4 and 5, the first and second levers 110 and 130 are rotatably connected to a rotational shaft 140 but may be structured so that the second lever 130 cannot rotate about the rotational shaft 140 during rotation of the first lever 110.

For this, the first lever 110 is formed larger than the second lever 130, and the second lever 130 is brought into contact with an upper front part of the first lever 110.

That is, the first lever 110 has a cut part 111 opened toward the upper part thereof to insert the second lever 130. A locking protrusion 113 may be formed inwardly along an inner edge of the cut part 111.

Also, a supporting part 131 may be formed along an outer edge of the second lever 130, being depressed by a predetermined depth in the shape corresponding to the locking protrusion 113 so that the second lever 130 is securely supported by the locking protrusion 113.

A rotational shaft hole 115 is formed at the upper part of the first lever 110 for connection with the rotational shaft 140. An insertion rib 117 is formed on an inner circumference of the rotational shaft hole 115 to be inserted in an insertion groove 141 formed at the rotational shaft 140, such that the first lever 110 and the rotational shaft 140 rotate together.

Additionally, a first elastic member connection part 119 is protruded outward on both upper surfaces of the first lever 110 to connect a first elastic member 150 which returns the first lever 110 in a rotated state to its initial state.

The first elastic member 150 may be a torsion spring of which one end is supported by the first lever 110 and the other end is supported by the case 81 (FIG. 3) of the dispenser 80 (FIG. 3).

A rotational shaft insertion part 133 is formed at an upper part of the second lever 130, including a center hole 135 with a greater diameter than the rotational shaft 140 to receive the rotational shaft 140. On an outer circumference of the rotational shaft insertion part 133, a second elastic member 160 may be formed to exert elasticity in the opposite direction to the rotational direction of the first lever 100 to thereby restrict rotation of the second lever 130 while the first lever 110 is rotating.

The second elastic member 160 may be a torsion spring supported by the second lever 130 with one end thereof and supported by the case 81 (FIG. 3) of the dispenser 80 (FIG. 3) on the other end. However, one or more embodiments, not being limited to this case, may adopt any other member as long as enabling the second lever 130 to exert a force against the rotational direction of the first lever 110.

As shown in FIGS. 4 and 5, when a user pushes the first lever 110, the first lever 110 is rotated about the rotational shaft 140 whereas the second lever 130 is restrained from rotating since being supported by the second elastic member 160.

When the user pushes the second lever 130, the second lever 130 is rotated together with the first lever 110 since the supporting part 131 of the second lever 130 is supported by the locking protrusion 113 of the first lever 110.

That is, the rotational shaft 140 is rotatably connected to one side of the case 81 (FIG. 3) of the dispenser 80 (FIG. 3) so as to be rotated along with the first lever 110 according to an embodiment. However, both the first and second levers 110 and 130 may be rotatably connected to the rotational shaft 140 while the rotational shaft 140 is static.

Figure 6:
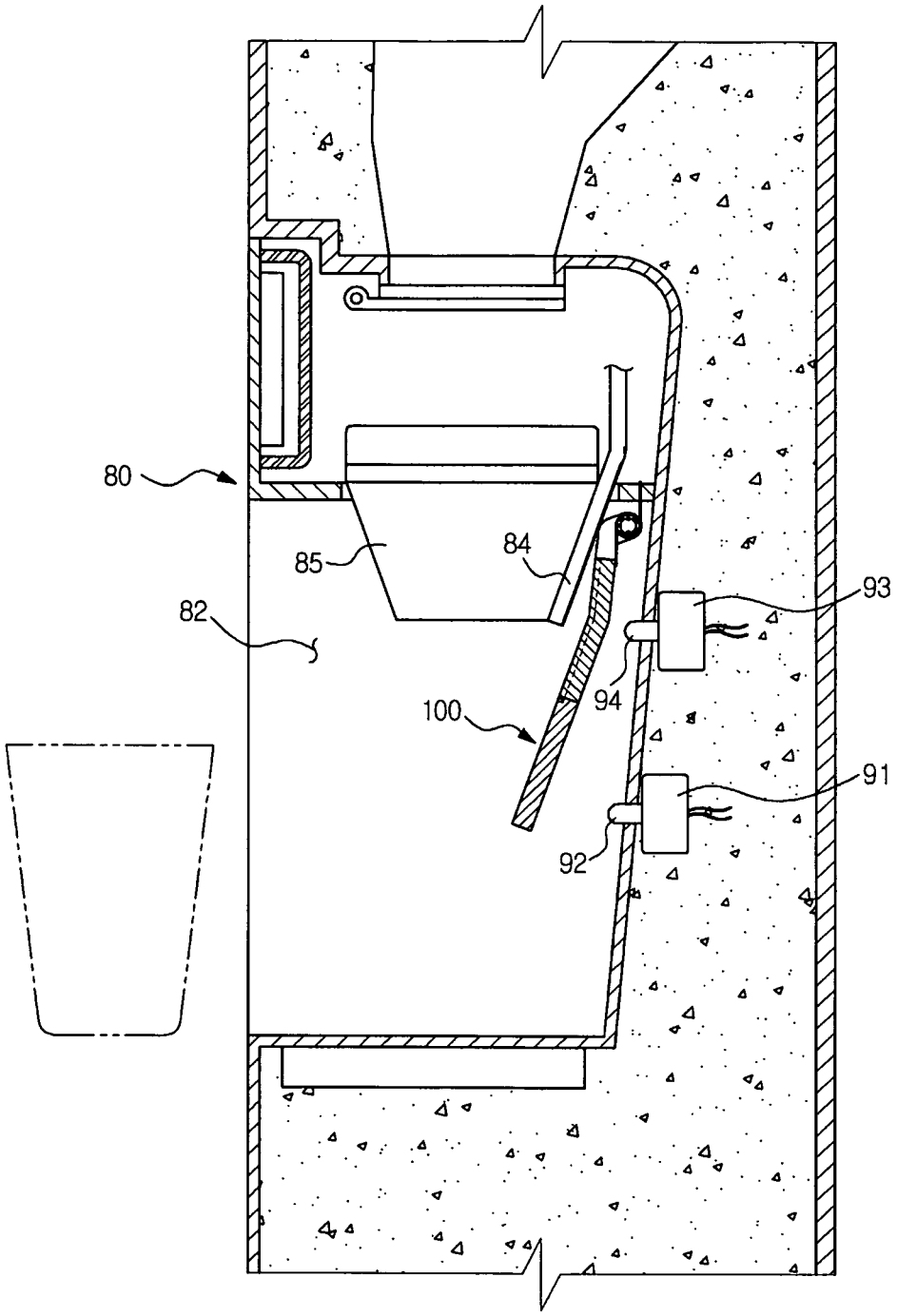
FIG. 6 is a sectional view schematically showing the structure of the operation lever and switches of the dispenser.

FIG. 6 is a sectional view schematically showing the structure of the operation lever and a switch of the dispenser according to one or more embodiments.

Referring to FIG. 6, switches 91 and 93 may be provided at a rear wall of the taking-out space 82 to be operated by the operation lever 100. As the operation lever 100 rotates and therefore pushes first and second operation parts 92 and 94 of the first and second switches 91 and 93, the switches 91 and 93 operate the water supply valve 51 (FIG. 1) or the ice supplying device of the ice maker 30 (FIG. 2), being electrically connected thereto, and thereby discharge water or ice.

The switches 91 and 93 may include a first switch 91 pressed by the first lever 110 (FIG. 5) and a second switch 93 pressed by the second lever 130 (FIG. 5).

The first switch 91 opens the water supply valve 51 (FIG. 1) so that the water in the water tank 40 (FIG. 2) is discharged to the intake port 84, and the second switch 93 operates the ice supplying device of the ice maker 30 (FIG. 2) so that the ice in the ice maker 30 (FIG. 2) is discharged to the ice discharging pipe 85.

Figure 7:
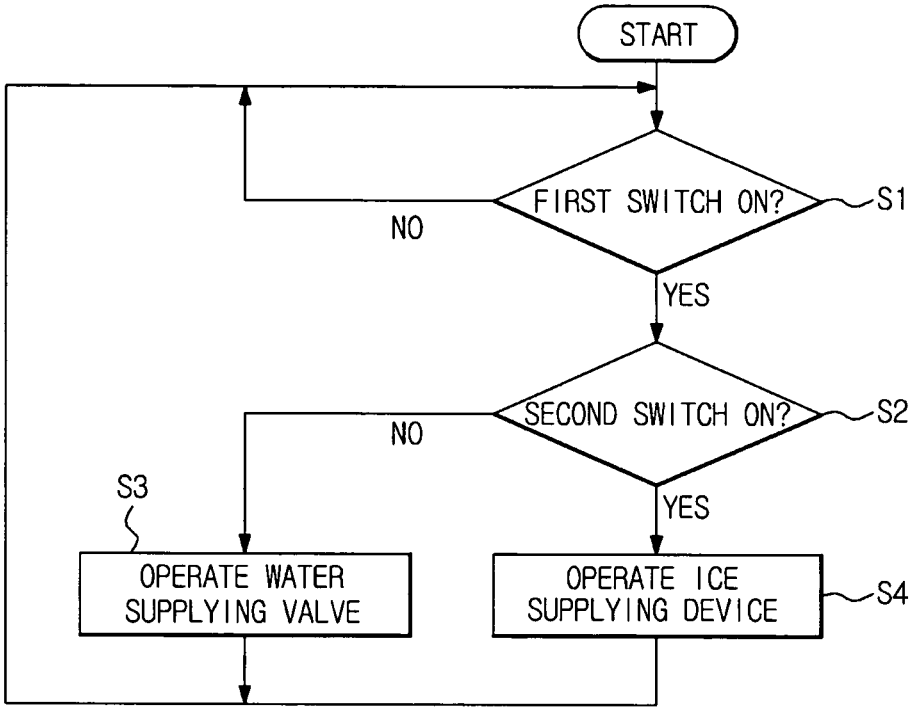
FIG. 7 is a flowchart explaining a controlling method for the refrigerator according to an embodiment.
Figure 8:
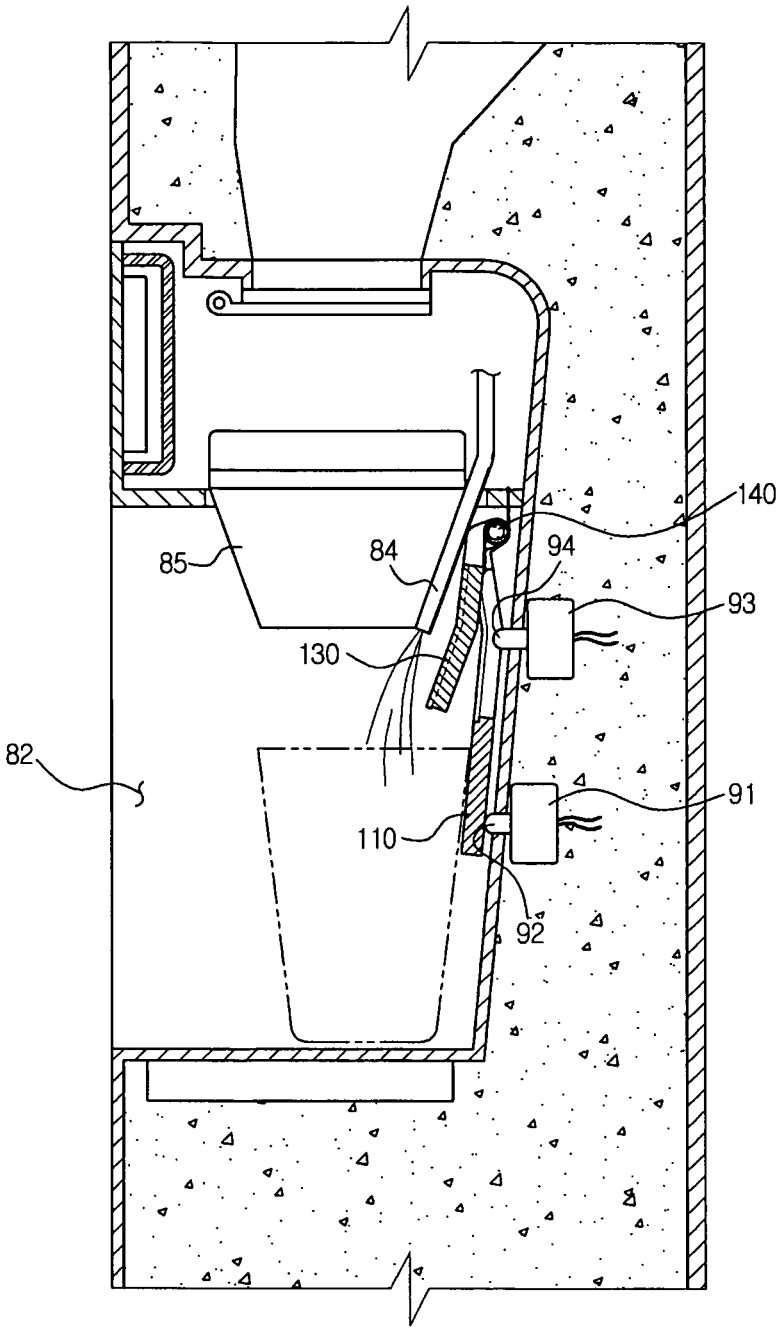
FIG. 8 is a sectional view showing the operation of the dispenser discharging water.
Figure 9:
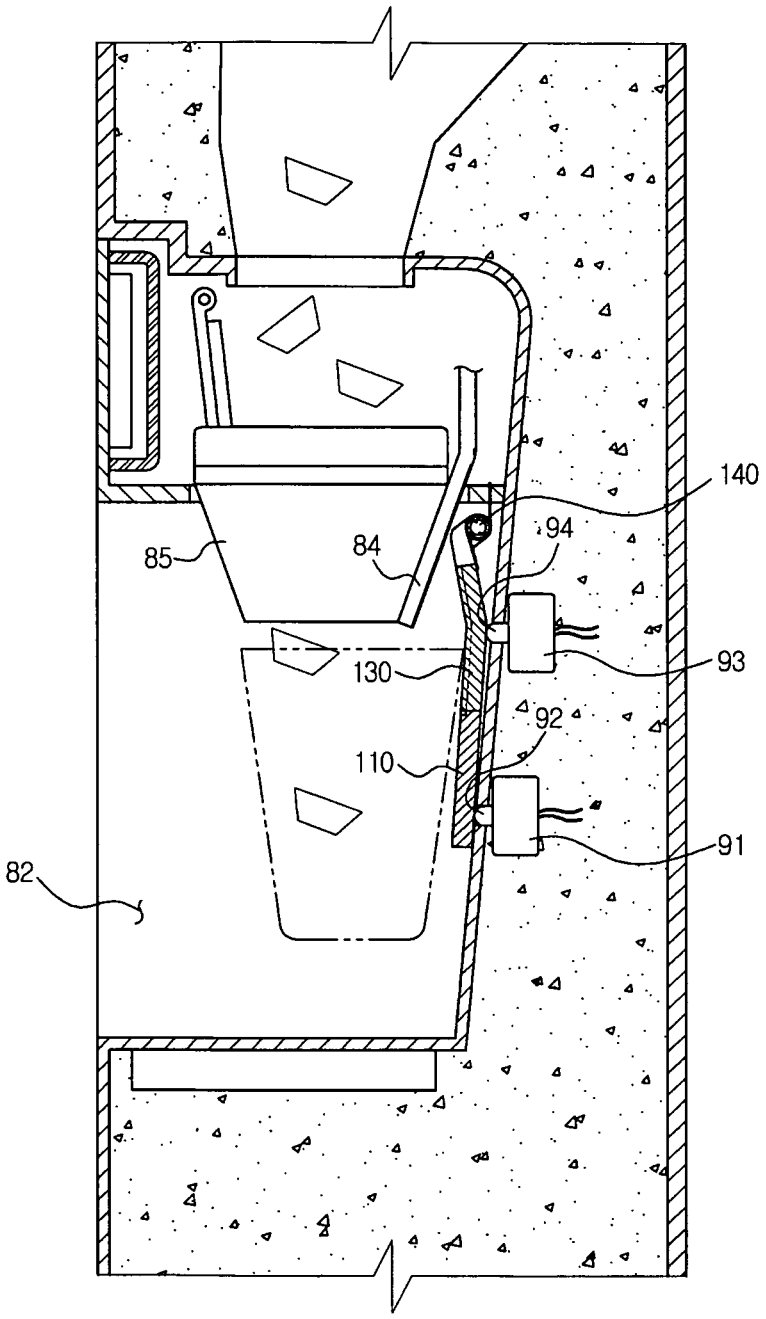
FIG. 9 is a sectional view showing the operation of the dispenser discharging ice.

FIG. 7 is a flowchart explaining a controlling method for the refrigerator according to an embodiment. FIG. 8 is a sectional view showing the operational state of the dispenser which is discharging water. FIG. 9 is a sectional view showing the operational state of the dispenser which is discharging ice.

Referring to FIGS. 6 and 7, first, the control unit (not shown) may discharge water or ice through the dispenser 80 according to signals of the first and second switches 91 and 93 during the operation of the refrigerator.

The control unit (not shown) according to an embodiment may, in operation S1, discharge water or ice according to whether only the first switch 91 is turned on or, in operation S2, according to whether the second switch 93 is also turned on with the first switch 91 turned on.

More specifically, when only the sensing signal of the first switch 91 is detected, in operation S3, the control unit opens the water supply valve 51 (FIG. 1) to discharge water. In operation S4, when the sensing signals of the first and second switches 91 and 93 are both detected, the water supply valve 51 (FIG. 1) is closed and the ice supplying device is operated to discharge the ice.

As shown in FIG. 8, when the user pushes the first lever 110 by putting a cup in the taking-out space 82, the first lever 110 is rotated about the rotational shaft 140, thereby pressing the first operation part 92 of the first switch 91 disposed at the rear wall of the taking-out space 82. However, since the second lever 130 is not rotated at this time, the second operation part 94 of the second switch 93 is inserted in the cut part 111 (FIG. 5) of the first lever 110 and therefore is not pressed.

Accordingly, the dispenser 80 (FIG. 6) supplies water from the water tank 40 (FIG. 1) to the intake port 84.

Meanwhile, referring to FIG. 9, when the user pushes the second lever 130 by putting a cup in the taking-out space 82, the first and the second levers 110 and 130 are rotated, thereby pressing the first and second operation parts 92 and 94 of the first and second switches 91 and 93 disposed at the rear wall of the taking-out space 82. As a result, the ice being discharged from the ice maker 30 (FIG. 2) is supplied into the cup through the ice discharging pipe 85.

Thus, the user may be able to solve inconvenience of dedicatedly pressing a button to select water or ice and then pushing the corresponding lever. Furthermore, since just a single operation lever 100 (FIG. 6) is disposed in the taking-out space 82, space efficiency and aesthetic appearance of the refrigerator may be greatly improved.

Figure 10:
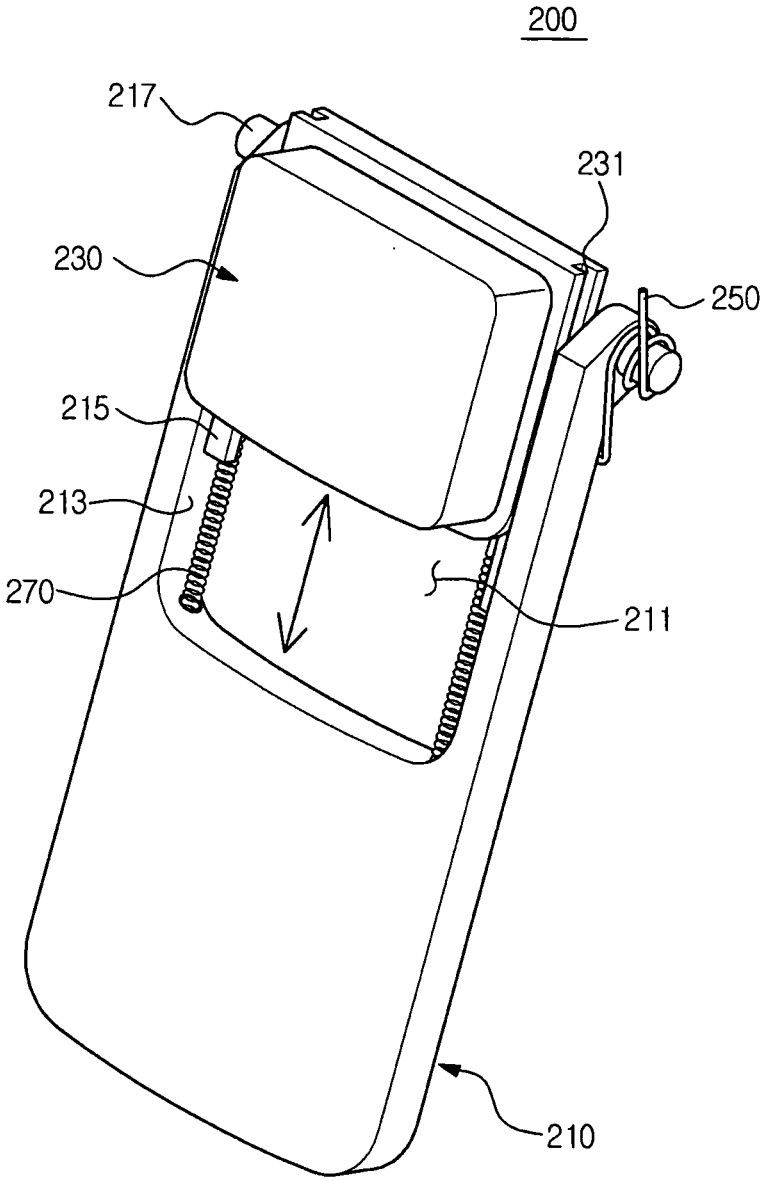
FIG. 10 is a perspective view of an operation lever for a dispenser, according to another embodiment.
Figure 11:
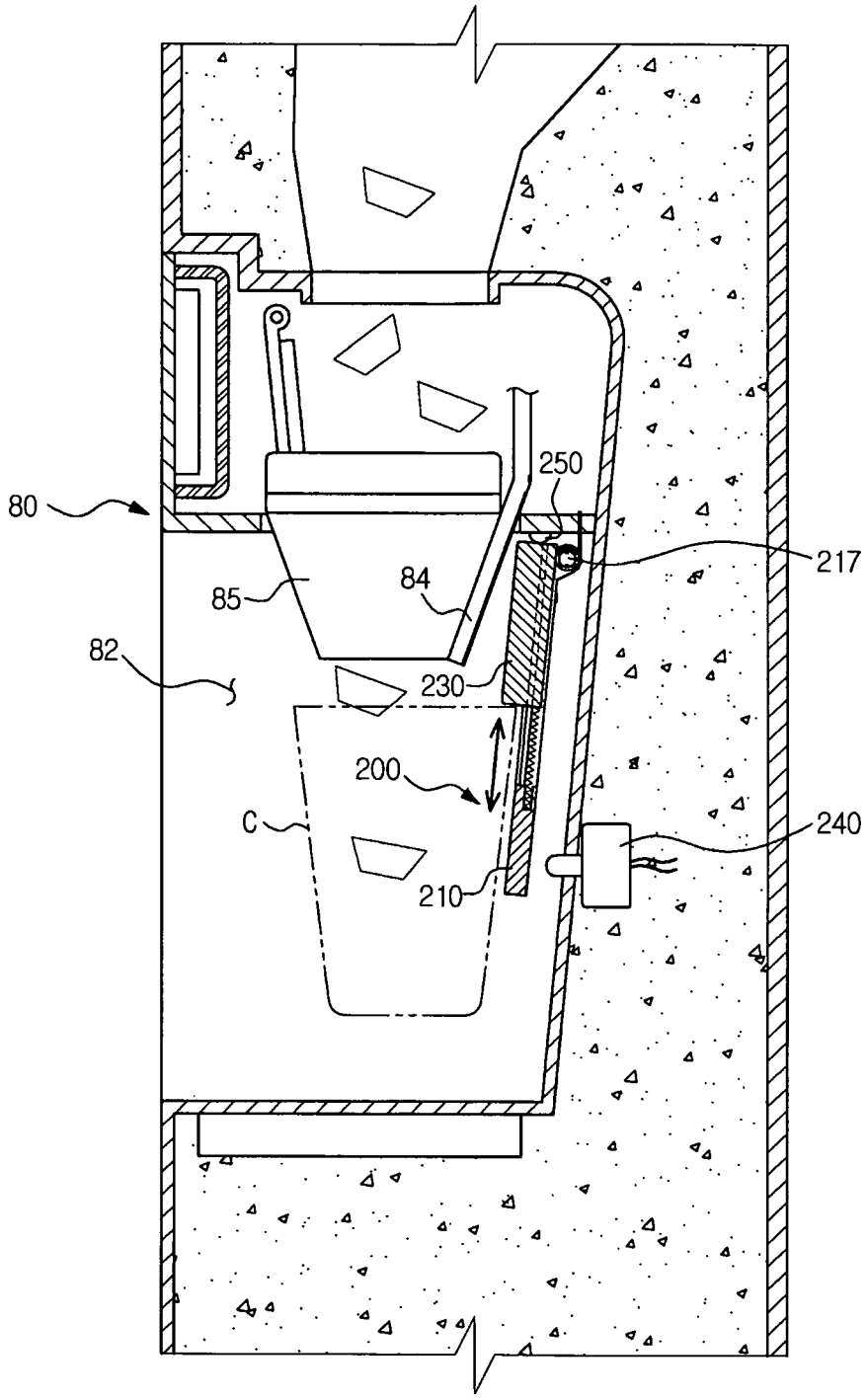
FIG. 11 is a sectional view showing the operational state of the dispenser operation lever of FIG. 10.

FIG. 10 is a perspective view of an operation lever for a dispenser, according to another embodiment, and FIG. 11 is a sectional view showing the operational state of the dispenser operation lever of FIG. 10. Hereinafter, structures having the same functions as described above will be cited by the same reference numerals while omitting detailed explanation thereof.

According to this embodiment, an operation lever 200 includes a first lever 210 and a second lever 230 which are relatively moved with respect to each other. For example, one of the first and second levers 210 and 230 may be slid with respect to the other one.

Specifically, guide rails 215 are formed on both inner sidewalls 213 of a cut part 211 opened toward an upper part of the first lever 210. Slide grooves 231 are formed on both sides of the second lever 230 that will be disposed in the cut part 211, to be slid up and down along the guide rails 215.

In addition, a second elastic member 270 such as a coil spring may be formed so that the second lever 230 may return to its initial position after being moved.

In this embodiment, switches for discharge of water and ice may be provided at a rear part of the first lever 210 and at an upper part of the lever 230, respectively, to function independently.

More particularly, as shown in FIGS. 10 and 11, the first lever 210 may be rotated about a rotational shaft 217 to thereby push an operation part of a first switch 240 disposed at the rear part of the first lever 210, so that the water is discharged to the dispenser 80. The second lever 230 may be slid along the guide rail 215 of the first lever 210, thereby pushing an operation part of a second switch 250 disposed at the upper part of the taking-out space 82 so that the ice is discharged to the dispenser 80.

Aspects of one or more embodiments are not limited to the above description but may further include a following embodiment.

In one or more embodiments, the second lever is slid relative to the first lever forward and backward or up and down. However, the second lever may be rotated in lateral directions with respect to the first lever.

In addition, although one or more embodiments have the switches respectively to sense the operations of the first and second levers, a two-way switch capable of performing two functions may be provided to selectively discharge water or ice by being connected to different contact points according to a pressing force of the levers.

In this case, a pressing protrusion may be further provided at the second lever to press a button of the two-way switch so that the pressing force is varied according to the rotation of the first and second levers.

Figure 12:
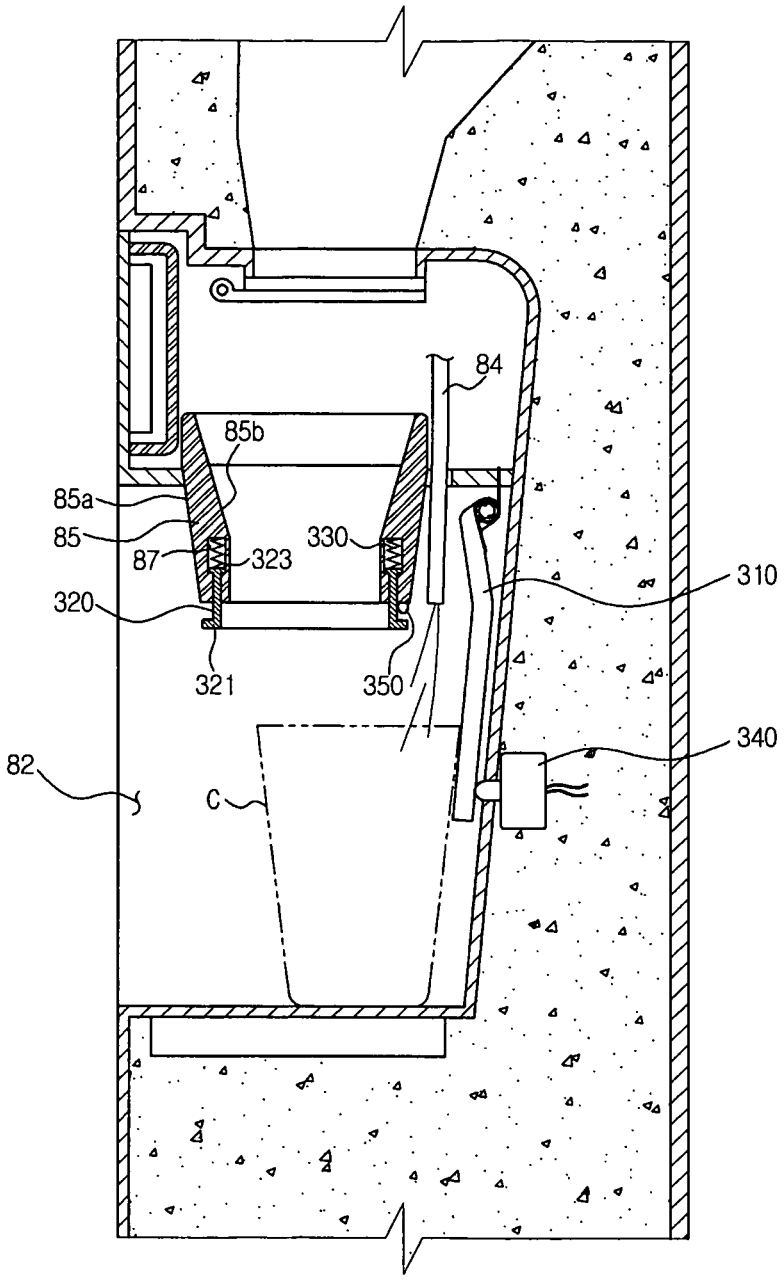
FIG. 12 is a sectional view showing an operation lever for a dispenser, according to still another embodiment.
Figure 13:
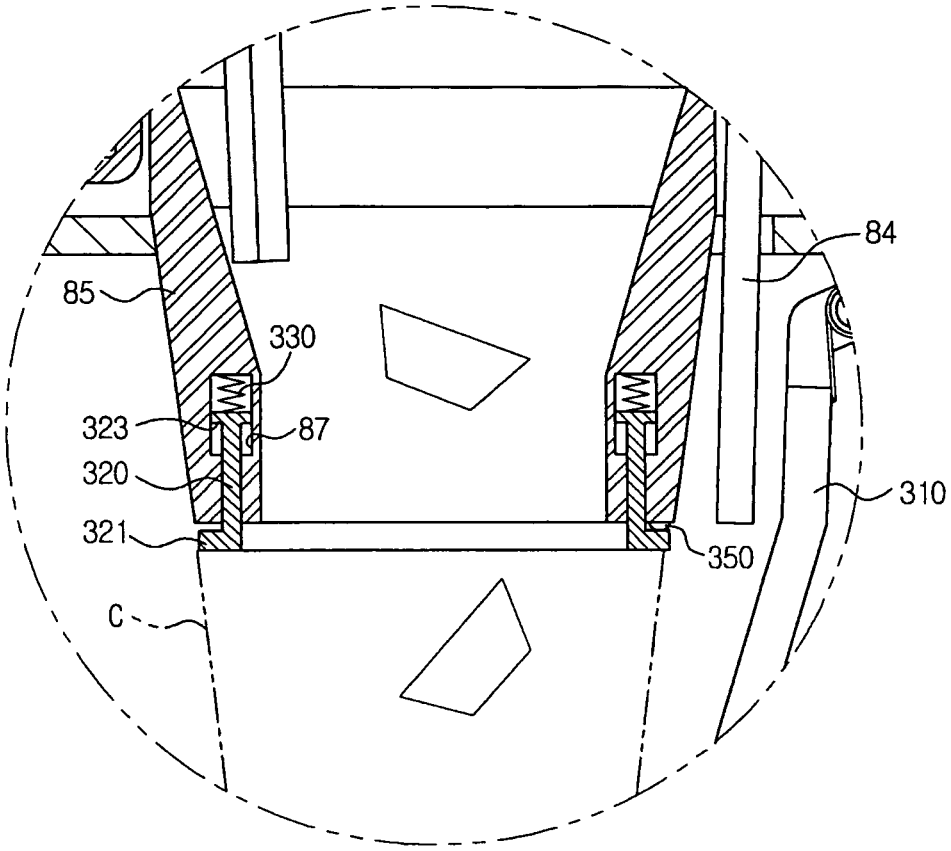
FIG. 13 is a partially enlarged view showing the operational state of the operation lever of FIG. 12.

FIG. 12 is a sectional view of an operation lever for a dispenser, according to still another embodiment and FIG. 13 is a partially enlarged view showing the operational state of the dispenser operation lever of FIG. 12. Hereinafter, structures having the same function as described above will be cited by the same reference numerals and not be explained in detail.

Referring to FIG. 12, an operation lever may include separate levers, that is, a first lever 310 to discharge beverage to the intake port 84 and a second lever 320 to discharge ice to the ice discharging pipe 85.

The first lever 310 is rotatably connected to one side of the taking-out space 82 to press a first switch 340 disposed at one side of a rear wall of the taking-out space 82. The second lever 320 is moved in an up and down direction at a lower part of the ice discharging pipe 85 so as to press a second switch 350 formed at one lower side of the ice discharging pipe 85.

The second switch 350 may be implemented by a general switch or a sensor that senses the movement of the second lever 320.

A connection groove 87 may be formed at the ice discharging pipe 85 for one end of the second lever 320 to be moved forward and backward therein. The connection groove 87 may be formed in a circumferential direction between an outer surface 85*a* and an inner surface 85*b* of the ice, discharging pipe 85, thereby supplying a space so that the second lever 320 is moved in the space as pushed.

The second lever 320 has a cylindrical form opened through the center. A push part 321 is formed at an end of the second lever 320 to push an upper end of a cup C inserted in the taking-out space 82. A connection part 323 is formed at the other end of the second lever 320, which is inserted in the connection groove 87 to be movable up and down and supported by a lower edge of the connection groove 87.

The connection part 323 may have a flange form extended from the other end of the second lever 320 in a radial direction to have a similar diameter to an inner diameter of the connection groove 87.

Meanwhile, the connection groove 87 has an elastic member 330 to return the second lever 320 being pushed, to its initial position.

The elastic member 330 may be a coil spring of which one end is supported by an upper end of the connection groove 87 and the other end is supported by the connection part 323 of the second lever 320. The elastic member 330 pushes the second lever 320 downward.

According to the above structure, as shown in FIG. 12, the user pushes the first lever 310 with the cup C when he or she wants to take out beverage from the taking-out space 8. Therefore, the first lever 310 presses the first switch 340 disposed at the one side of the rear wall of the taking-out space 82, thereby supplying the purified beverage from the intake port 84 to the cup C.

In addition, referring to FIG. 13, when the user wants to take out ice, the user may bring the cup C into contact with the push part 321 of the second lever 320 and push the cup C upward, so that the second lever 320 is moved to the upper part of the ice discharging pipe 85 and presses the second switch 350 disposed at one lower side of the ice discharging pipe 85. Accordingly, the user is supplied with the ice discharged to the ice discharging pipe 85.

When the cup C is removed afterward, the elastic member 330 pushes the second lever 320 downward, thereby returning the second lever 320 to the initial position and relieving the second switch 350 from the pressing force.

Thus, the user may be able to take out beverage or ice through a simple operation by providing the operation lever which improves user convenience.

As is apparent from the above description, an operation lever for a dispenser according to one or more embodiments does not dedicatedly need a function conversion button to select whether to take out ice or water from the dispenser. Accordingly, user convenience may be improved.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An operation lever for a dispenser of a refrigerator, comprising:

a first lever comprising a lower portion, first and second protrusions extending from opposite ends of an upper side of the lower portion, and a cut part formed between the first and second protrusions;

a second lever disposed within the cut part of the first lever between the first and second protrusions, such that the first lever and the second lever are interconnected to press a first switch and a second switch, respectively; and a rotational shaft to which each of the second lever, an end portion of the first protrusion, and an end portion of the second protrusion is rotatably connected, wherein an interconnection of the first lever and the second lever provides operation of the first lever without moving the second lever upon only the first lever being operated to press the first switch, and provides the second lever being moved along with the first lever upon the second lever being operated to press the second switch, the end portions of the first and second protrusions are end portions of the first lever, the second lever is formed relatively smaller than the first lever and is disposed in front of the first lever, the cut part is opened to one side, the first lever further comprises a locking protrusion formed along an inner edge of the cut part to be supported by a supporting part recessed along an edge of the second lever, the locking protrusion is formed along a surface of the first protrusion facing the second protrusion, along a surface of the second protrusion facing the first protrusion, and along an edge of the lower portion of the first lever facing the cut part, and the interconnection comprises the locking protrusion and the supporting part.

2. An operation lever for a dispenser of a refrigerator, comprising:

a rotational shaft;

a first lever having a cut part formed on an upper portion of the first lever, the cut part forming an open upper side of the first lever and being between two opposite upper end portions of the first lever, and the first lever being rotatably connected to the rotational shaft at the upper end portions of the first lever;

a second lever formed relatively smaller than the first lever, disposed within the cut part of the first lever and rotatably connected to the rotational shaft between the opposite ends of the upper portion of the first lever so as to be rotated along with the first lever;

a first elastic member elastically supporting the first lever so that the first lever is returned to an initial position after being rotated;

a second elastic member elastically supporting the second lever so as to restrict rotation of the second lever while the first lever is rotating; and a rotational shaft to which each of the second lever and the two upper end portions is rotatably connected, wherein the cut part is opened to one side, the first lever further comprises a locking protrusion formed along an inner edge of the cut part to be supported by a supporting part recessed along an edge of the second lever, the locking protrusion is formed along a surface of a first of the two upper end portions facing a second of the two upper end portions, along a surface of the second of the two upper end portions facing the first of the two upper end portions, and along an edge of the lower portion of the first lever facing the cut part, and an interconnection between the first lever and the second lever comprises the locking protrusion and the supporting part.

3. A refrigerator, comprising:

a main body equipped with a storage chamber;

a door opening and closing the storage chamber;

a dispenser formed at one side of the door to enable taking-out of beverage and ice from outside;

first and second switches formed at one side of the dispenser for taking-out of the beverage and ice; and an operation lever pressing the first and second switches, and including:

a first lever comprising a lower portion, first and second protrusions extending from opposite ends of an upper side of the lower portion, and a cut part formed between the first and second protrusions;

a second lever disposed within the cut part of the first lever between the first and second protrusions, the first lever and second lever being interconnected to press the first switch and the second switch, respectively; and a rotational shaft to which each of the second lever, an end portion of the first protrusion, and an end portion of the second protrusion is rotatably connected, wherein an interconnection of the first lever and the second lever provides operation of the first lever without moving the second lever upon only the first lever being operated to press the first switch, and provides the second lever being moved along with the first lever upon the second lever being operated to press the second switch, the end portions of the first and second protrusions are end portions of the first lever, the second lever is formed relatively smaller than the first lever and is disposed in front of the first lever, the cut part is opened to one side, the first lever further comprises a locking protrusion formed along an inner edge of the cut part to be supported by a supporting part recessed along an edge of the second lever, the locking protrusion is formed along a surface of the first protrusion facing the second protrusion, along a surface of the second protrusion facing the first protrusion, and along an edge of the lower portion of the first lever facing the cut part, and the interconnection comprises the locking protrusion and the supporting part.

4. A refrigerator comprising:

a main body equipped with a storage chamber;

a door opening and closing the storage chamber;

a taking-out space disposed at one side of the door;

an ice discharging pipe and an intake port disposed at an upper part of the taking-out space to discharge ice and beverage, respectively;

a first lever rotatably mounted in the taking-out space to press a first switch formed at one side of the taking-out space and thereby to discharge beverage to the intake port, the first lever comprising a lower portion, first and second protrusions extending from opposite ends of an upper side of the lower portion, and a cut part formed between the first and second protrusions;

a second lever mounted at a lower part of the ice discharging pipe and moved in an up and down direction to press a second switch formed at one side of the ice discharging pipe and thereby to supply ice to the ice discharging pipe; and a rotational shaft to which each of the second lever, an end portion of the first protrusion, and an end portion of the second protrusion is rotatably connected, wherein the first lever selectively operates to perform a first function without movement of the second lever, or to perform a second function with simultaneous movement of the first and second levers, the simultaneous movement provided by an interconnection between the first lever and the second lever, the end portions of the first and second protrusions are end portions of the first lever, the second lever is formed relatively smaller than the first lever and is disposed in front of the first lever, the cut part is opened to one side, the first lever further comprises a locking protrusion formed along an inner edge of the cut part to be supported by a supporting part recessed along an edge of the second lever, the locking protrusion formed along a surface of the first protrusion facing the second protrusion, along with a surface of the second protrusion facing the first protrusion, and along an edge of the lower portion of the first lever facing the cut part, and the interconnection comprises the locking protrusion and the supporting part.

5. An operation lever for a dispenser of a refrigerator, comprising:

a first lever comprising a lower portion, first and second protrusions extending from opposite ends of an upper side of the lower portion, and a cut part formed between the first and second protrusions; and a second lever disposed within the cut part of the first lever between the first and second protrusions; and a rotational shaft to which each of the second lever, an end portion of the first protrusion, and an end portion of the second protrusion is rotatably connected, wherein the first lever selectively operates to perform a first function without movement of the second lever, or to perform a second function with simultaneous movement of the first and second levers, the simultaneous movement provided by an interconnection between the first lever and the second lever, the end portions of the first and second protrusions are end portions of the first lever, the second lever is formed relatively smaller than the first lever and is disposed in front of the first lever, the cut part is opened to one side, the first lever further comprises a locking protrusion formed along an inner edge of the cut part to be supported by a supporting part recessed along an edge of the second lever, the locking protrusion formed along a surface of the first protrusion facing the second protrusion, along a surface of the second protrusion facing the first protrusion, and along an edge of the lower portion of the first lever facing the cut part, and the interconnection comprises the locking protrusion and the supporting part.

6. The operation lever according to claim 1, further comprising:

a first elastic member elastically supporting the first lever to return the first lever to an initial position after being rotated; and a second elastic member elastically supporting the second lever in an opposite direction to the rotational direction of the first lever to restrict rotation of the second lever while the first lever is rotating.

7. The refrigerator according to claim 3, further comprising:

a first elastic member returning the first lever in a rotated state to an initial state; and a second elastic member restricting rotation of the second lever during rotation of the first lever, and returning the second lever in a rotated state to an initial state, wherein the first lever is disposed at a rear part of the second lever to be rotated along with the second lever when the second lever rotates.

8. The refrigerator according to claim 4, wherein the ice discharging pipe has a connection groove for one end of the second lever to reciprocate therein, and the connection groove has an elastic member to return the second lever in a moved state to an initial position.

9. The refrigerator according to claim 8, wherein the second lever comprises:

a push part formed at one end thereof to push the second lever; and a connection part formed at the other end thereof to be movably inserted in the connection groove and supported by a lower edge of the connection groove.

10. The operation lever according to claim 5 wherein the first lever presses a first switch, and the second lever presses a second switch.

11. The operation lever according to claim 5, wherein the first function is to dispense a beverage, and the second function is to dispense ice.

12. The operation lever according to claim 5, wherein a receiving container is used to operate the first lever and the second lever.

13. The operation lever according to claim 5, wherein the first lever and the second lever are pushed to be operated.

14. The operation lever according to claim 5, wherein the interconnection provides operation of the first lever without moving the second lever upon only the first lever being operated, and provides the second lever being moved along with the first lever upon the second lever being operated.

15. The operation lever according to claim 14, wherein the interconnection engages the first lever when the second lever is operated.

16. The operation lever according to claim 14, wherein the first and second levers return to an initial position after being operated.

* * * * *